US006285336B1

(12) United States Patent
Zimmerman

(10) Patent No.: US 6,285,336 B1
(45) Date of Patent: Sep. 4, 2001

(54) FOLDED DIPOLE ANTENNA

(75) Inventor: Martin L. Zimmerman, Chicago, IL (US)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/432,524

(22) Filed: Nov. 3, 1999

(51) Int. Cl.[7] ..... H01Q 9/26
(52) U.S. Cl. ..... 343/803; 343/795
(58) Field of Search ..... 343/700 MS, 795, 343/797, 803, 815, 818, 846, 848

(56) References Cited

U.S. PATENT DOCUMENTS

| | | | |
|---|---|---|---|
| H001460 | 7/1995 | Davis | 343/700 MS |
| 2,130,033 | 9/1938 | Scharlau . | |
| 2,455,403 | 10/1948 | Brown . | |
| 2,465,673 | 3/1949 | Breen et al. | 250/33.65 |
| 2,750,589 | 6/1956 | Harris . | |
| 2,785,399 | 3/1957 | Harris . | |
| 3,196,443 | 7/1965 | Martin | 343/797 |
| 3,482,253 | 12/1969 | Zucconi . | |
| 3,496,570 | 2/1970 | Lewis . | |
| 3,680,139 | 7/1972 | Reynolds, Jr. | 343/756 |
| 3,680,143 | 7/1972 | Ajioka et al. | 343/778 |
| 3,681,769 | 8/1972 | Perrotti et al. | 343/814 |
| 3,681,771 | 8/1972 | Lewis et al. | 343/817 |
| 3,718,935 | 2/1973 | Ranghelli et al. | 343/797 |
| 3,720,953 | 3/1973 | Ajioka | 343/771 |
| 3,740,754 | 6/1973 | Epis | 343/797 |

(List continued on next page.)

FOREIGN PATENT DOCUMENTS

| | | |
|---|---|---|
| 922 8386 | 5/1993 | (AU) . |
| 952 7118 | 2/1996 | (AU) . |
| 0 416 300 | 3/1991 | (EP) . |
| 0 464 255 | 1/1992 | (EP) . |
| 0 523 770 | 1/1993 | (EP) . |
| 0 566 522 | 10/1993 | (EP) . |
| 0 647 977 | 4/1995 | (EP) . |
| 0 657 956 | 6/1995 | (EP) . |
| 0 495 507 | 11/1995 | (EP) . |
| 0 715 477 | 6/1996 | (EP) . |
| 0 725 498 | 8/1996 | (EP) . |
| 0 433 255 | 1/1997 | (EP) . |
| 1236535 | 6/1959 | (FR) . |

OTHER PUBLICATIONS

Brian Edward and Daniel Rees, "A Broadband Printed Dipole With Integrated Balun" Microwave Journal May 1987 (pp. 339–344).

Willmar K. Roberts, "A New Wide–Band Balun" IRE, Jun. 1957 (pp. 1628–1631).

"Planar Integrated Antenna Technology", *Microwave Journal*, Jul. 1999, pp. 128–144 (article appears on even numbered pages only).

Article; "Planar Integrated Antenna Technology," *Microwave Journal*, Jul. 1999, 9 pgs.

*Primary Examiner*—Tan Ho
(74) *Attorney, Agent, or Firm*—Stephen G. Rudisill; Jenkens & Gilchrist

(57) ABSTRACT

A folded dipole antenna for transmitting and receiving electromagnetic signals is provided. The antenna includes a ground plane and a conductor extending adjacent the ground plane and spaced therefrom by a dielectric. The conductor includes three sections: a feed section, a radiator input section, and at least one radiating section integrally formed with the feed section. The radiating section includes first and second ends, a fed dipole and a passive dipole. The fed dipole is connected to the radiator input section. The passive dipole is disposed in spaced relation to the fed dipole to form a gap. The passive dipole is shorted to the fed dipole at the first and second ends.

46 Claims, 8 Drawing Sheets

U.S. PATENT DOCUMENTS

| | | | | |
|---|---|---|---|---|
| 3,742,506 | | 6/1973 | Wilkinson | 343/854 |
| 3,747,114 | | 7/1973 | Shyhalla | 343/795 |
| 3,750,185 | | 7/1973 | Evans | 343/814 |
| 3,757,342 | | 9/1973 | Jasik et al. | 343/738 |
| 3,810,185 | | 5/1974 | Wilkinson | 343/756 |
| 3,813,674 | * | 5/1974 | Sidford | 343/730 |
| 3,821,742 | | 6/1974 | Pollard | 343/727 |
| 3,922,680 | | 11/1975 | Alsberg et al. | 343/754 |
| 4,015,263 | | 3/1977 | Koerner et al. | 343/708 |
| 4,015,265 | * | 3/1977 | Dubost et al. | 343/747 |
| 4,031,537 | | 6/1977 | Alford | 343/707 |
| 4,087,818 | | 5/1978 | Kreutel, Jr. . | |
| 4,180,817 | | 12/1979 | Sanford | 343/700 MS |
| 4,193,077 | | 3/1980 | Greenberg et al. | 343/747 |
| 4,223,317 | | 9/1980 | Rod | 343/819 |
| 4,263,598 | | 4/1981 | Bellee et al. | 343/700 MS |
| 4,287,518 | | 9/1981 | Ellis, Jr. | 343/700 MS |
| 4,340,891 | | 7/1982 | Phillips | 343/713 |
| 4,364,050 | | 12/1982 | Lopez | 343/700 MS |
| 4,412,222 | | 10/1983 | Mohring et al. | 343/779 |
| 4,446,465 | | 5/1984 | Donovan | 343/797 |
| 4,464,663 | | 8/1984 | Lalezari et al. | 343/700 MS |
| 4,472,717 | | 9/1984 | Eaves et al. | 343/361 |
| 4,498,085 | | 2/1985 | Schwarzmann | 343/795 |
| 4,504,836 | | 3/1985 | Seavey | 343/761 |
| 4,518,969 | | 5/1985 | Bogner | 343/819 |
| 4,571,591 | | 2/1986 | Valentino et al. | 343/754 |
| 4,644,562 | | 2/1987 | Kavehrad et al. | 375/14 |
| 4,658,262 | | 4/1987 | DuHamel | 343/792.5 |
| 4,675,685 | | 6/1987 | Finken | 343/708 |
| 4,686,536 | | 8/1987 | Allock | 343/700 |
| 4,695,844 | | 9/1987 | Houchangnia | 343/781 CA |
| 4,710,775 | | 12/1987 | Coe | 343/727 |
| 4,737,793 | | 4/1988 | Munson et al. | 342/361 |
| 4,772,891 | | 9/1988 | Svy | 343/707 |
| 4,821,039 | | 4/1989 | Crane | 342/153 |
| 4,825,220 | | 4/1989 | Edward et al. | 343/795 |
| 4,839,663 | | 6/1989 | Kurtz | 343/771 |
| 4,870,426 | | 9/1989 | Lamberty et al. | 343/727 |
| 4,929,961 | | 5/1990 | Nakase | 343/715 |
| 4,943,811 | | 7/1990 | Alden et al. | 343/814 |
| 5,146,234 | | 9/1992 | Lalezari | 343/895 |
| 5,157,409 | | 10/1992 | Hamin | 343/715 |
| 5,172,080 | | 12/1992 | Fisher et al. | 333/1.1 |
| 5,206,655 | | 4/1993 | Caille et al. | 343/700 MS |
| 5,220,330 | | 6/1993 | Salvail et al. | 343/705 |
| 5,227,807 | | 7/1993 | Bohlman et al. | 343/895 |
| 5,268,701 | | 12/1993 | Smith | 343/767 |
| 5,274,391 | | 12/1993 | Connolly | 343/820 |
| 5,309,165 | | 5/1994 | Segal et al. | 343/770 |
| 5,319,379 | | 6/1994 | Waken et al. | 343/756 |
| 5,321,414 | | 6/1994 | Alden et al. | 343/816 |
| 5,400,042 | | 3/1995 | Tulinsteff | 343/727 |
| 5,451,969 | | 9/1995 | Toth et al. | 343/781 CA |
| 5,453,751 | | 9/1995 | Tsukamoto et al. | 343/700 MS |
| 5,481,272 | | 1/1996 | Yarsunas | 343/797 |
| 5,495,260 | | 2/1996 | Couture | 343/795 |
| 5,499,033 | | 3/1996 | Smith | 343/700 MS |
| 5,534,877 | | 7/1996 | Sorbello et al. | 343/700 MS |
| 5,539,414 | * | 7/1996 | Keen | 343/700 MS |
| 5,589,843 | | 12/1996 | Meredith et al. | 343/820 |
| 5,629,713 | | 5/1997 | Mailandt et al. | 343/809 |
| 5,630,226 | | 5/1997 | Kanda et al. | 455/313 |
| 5,742,258 | | 4/1998 | Kumpfbeck et al. | 343/795 |
| 5,818,397 | | 10/1998 | Yarsunas et al. | 343/797 |
| 5,917,456 | * | 6/1999 | Teunisse | 343/795 |
| 5,936,590 | | 8/1999 | Funder | 343/795 |
| 5,936,599 | | 8/1999 | Funder | 343/795 |
| 6,034,649 | | 3/2000 | Wilson et al. | 343/795 |

* cited by examiner

FOLDED DIPOLE ANTENNA

FIELD OF THE INVENTION

The present invention relates generally to antennas. More particularly, it concerns a folded dipole antenna for wireless telecommunications systems.

BACKGROUND OF THE INVENTION

Base station antennas used in wireless telecommunication systems have the capability to transmit and receive electromagnetic signals. Received signals are processed by a receiver at the base station and fed into a communications network. Transmitted signals are transmitted at different frequencies than the received signals.

Due to the increasing number of base station antennas, manufacturers are attempting to minimize the size of each antenna and reduce manufacturing costs. Moreover, the visual impact of base station antenna towers on communities has become a societal concern. Thus, it is desirable to reduce the size of these towers and thereby lessen the visual impact of the towers on the community. The size of the towers can be reduced by using smaller base station antennas.

There is also a need for an antenna with wide impedance bandwidth which displays a stable far-field pattern across that bandwidth. There is also a need for increasing the bandwidth of existing single-polarization antennas so they can operate in the cellular, Global System for Mobile (GSM), Personal Communication System (PCS), Personal Communication Network (PCN), and Universal Mobile Telecommunications System (UMTS) frequency bands.

The present invention addresses the problems associated with prior antennas by providing a novel folded dipole antenna including a conductor forming one or more integrated radiating sections. This design exhibits wide impedance bandwidth, is inexpensive to manufacture, and can be incorporated into existing single-polarization antenna designs.

SUMMARY OF THE INVENTION

A folded dipole antenna for transmitting and receiving electromagnetic signals is provided. The antenna includes a ground plane and a conductor extending adjacent the ground plane and spaced therefrom by a dielectric. The conductor includes three sections: a feed section, a radiator input section, and at least one radiating section integrally formed with the feed section. The radiating section includes first and second ends, a fed dipole and a passive dipole. The fed dipole is connected to the radiator input section. The passive dipole is disposed in spaced relation to the fed dipole to form a gap. The passive dipole is shorted to the fed dipole at the first and second ends.

BRIEF DESCRIPTION OF THE DRAWINGS

Other objects and advantages of the invention will become apparent upon reading the following detailed description and upon reference to the accompanying drawings, in which.

Figure 1A:
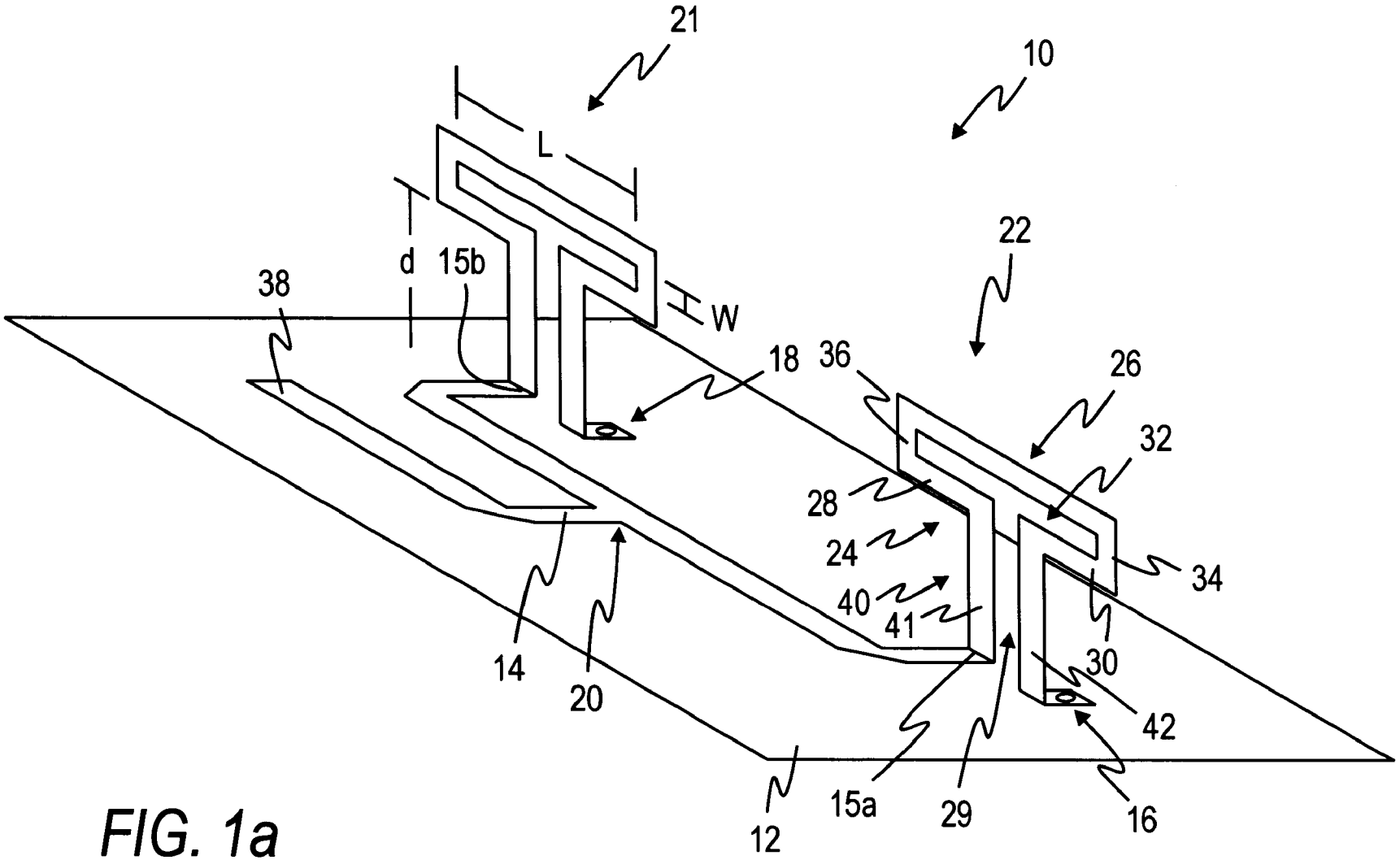
FIG. 1*a* is an isometric view of a folded dipole antenna according to one embodiment of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

The present invention is useful in wireless, broadcast, military and other such communication systems. One embodiment of the present invention operates across various frequency bands, such as the North American Cellular band of frequencies of 824–896 MHz, the North American Trunking System band of frequencies of 806–869 MHz, the Global System for Mobile (GSM) band of frequencies of 870–960 MHz. Another embodiment of the invention operates across several different wireless bands, such as the Personal Communication System (PCS) band of frequencies of 1850–1990 MHz, the Personal Communication Network (PCN) band of frequencies of 1710–1880 MHz, and the Universal Mobile Telecommunications System (UMTS) band of frequencies of 1885–2170 MHz. In this embodiment, wireless telephone users transmit electromagnetic signals to a base station tower that includes a plurality of antennas which receive the signals transmitted by the wireless telephone users. Although useful in base stations, the present invention can also be used in all types of telecommunications systems.

The antenna illustrated in FIGS. 1*a*–4*b* is a folded dipole antenna 10 for transmitting and receiving electromagnetic signals. The antenna 10 includes a ground plane 12 and a conductor 14 formed from a single sheet of conductive material. The conductor 14 consists of three sections, a feed section 20, a radiator input section 40, and at least one radiating section 22. The feed section 20 extends adjacent the ground plane 12 and is spaced therefrom by a dielectric, such as air, foam, etc., as shown in FIG. 1*b*. The radiating section 22 is spaced from the surface or edge of the ground plane 12 in order to provide an antenna capable of wide bandwidth operation that still has a compact size. The radiator input section 40 consists of two conductor sections 41 and 42 separated by a gap 29. The conductor section 41connects one part of the radiating section 22 to the feed line 20 and the conductor section 42 connects another part of the radiating section 22 to the ground plane 12. The radiator input section 40 has an intrinsic impedance that is adjusted to match the radiating section 22 to the feed section 20. This impedance is adjusted by varying the width of the conductor sections 41, 42 and the gap 29.

Figure 1B:
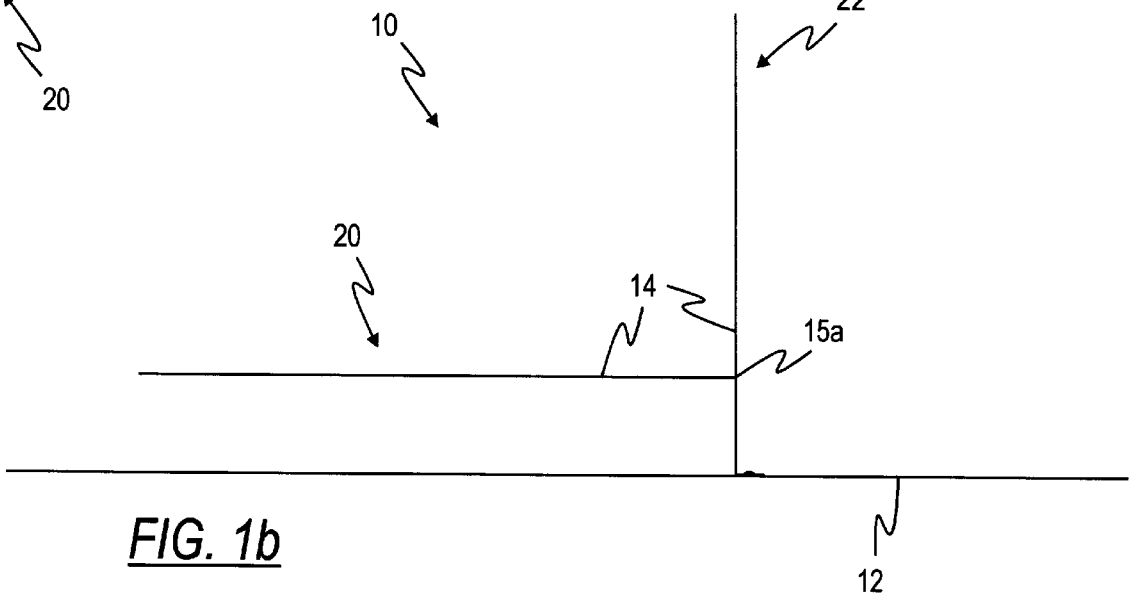
FIG. 1*b* is a side view of the folded dipole antenna of FIG. 1*a;*

In the illustrated embodiments of FIGs. 1*a*–*e*, the antenna 10 includes two radiating sections 21 and 22. In the illustrated embodiments, the conductor 14 is mechanically and electrically connected to the ground plane 12 at two locations 16 and 18. The radiating sections 21, 22 are supported at a distance d above the ground plane 12. In the wireless frequency band (1710–2170 MHz) embodiment, the distance d=1.22". The conductor 14 is bent at bends 15*a* and 15*b* such that the feed section is supported by and displaced from the ground plane 12, as shown in FIG. 1*b*. As a result, the feed section 20 is generally parallel to the ground plane 12. The feed section 20 includes an RF input section 38 that is adapted to electrically connect to a transmission line. The transmission line is generally electrically connected to an RF device such as a transmitter or a receiver. In one embodiment, the RF input section 38 directly connects to the RF device.

The two illustrated radiating sections 21, 22 are identical in construction, thus only radiating section 22 will be described in detail. Radiating section 22 includes a fed dipole 24 and a passive dipole 26. The fed dipole 24 comprises a first quarter-wavelength monopole 28 and a second quarter-wavelength monopole 30. The first quarter-wavelength monopole 28 is connected to the conductor section 41. The other end of the conductor section 41 is connected to the feed section 20. The second quarter-wavelength monopole 30 is connected to the conductor section 42. The other end of conductor section 42 is connected to the ground plane 12 at location 16.

The conductor section 42 can be connected to the ground plane 12 by any suitable fastening device such as a nut and bolt, a screw, a rivet, or any suitable fastening method including soldering, welding, brazing, and cold forming. A suitable connection provides both an electrical and mechanical connection between conductor 14 and ground plane 12. Thus, the antenna 10 is protected from overvoltage and overcurrent conditions caused by transients such as lightning. One method of forming a good electrical and mechanical connection is the cold forming process developed by Tox Pressotechnik GmbH of Weingarten, Germany (hereinafter "the cold forming process"). The cold forming process deforms and compresses one metal surface into another metal surface to form a Tox button. The cold forming process uses pressure to lock the two metal surfaces together. This process eliminates the need for separate mechanical fasteners to secure two metal surfaces together. Thus, in the embodiment where the radiating sections 21, 22 are attached to ground plane 12 by the cold forming process, the resulting Tox buttons at locations 16 and 18 provide structural support to the radiating sections 21, 22 and provide an electrical connection to the ground plane 12. Attaching the conductor 14 to the ground plane 12 by the cold forming process minimizes the intermodulation distortion (IMD) of the antenna 10. Certain other types of electrical connections such as welding will also minimize the IMD of the antenna 10.

The passive dipole 26 is disposed parallel to and spaced from the fed dipole 24 to form a gap 32. The passive dipole 26 is shorted to the fed dipole 24 at opposing ends 34 and 36 of the gap 32. The gap 32 has a length L and a width W, where the length L is greater than the width W. In one embodiment where the antenna 10 is used in the UMTS band of frequencies, the gap length L=2.24" and the gap width W=0.20" while the dipole length is 2.64" and the dipole width is 0.60".

The gap 32 forms a first half-wavelength dipole (passive dipole 26) on one side of the gap 32 and a second half-wavelength dipole (fed dipole 24) on the other side of the gap 32. The centrally-located gap 29 separates the fed dipole 24 into the first quarter-wavelength monopole 28 and the second quarter-wavelength monopole 30. Portions of the conductor 14 at opposing ends 34 and 36 of the gap 32 electrically connect the fed dipole 24 with the passive dipole 26. The gap 29 causes the conductor sections 41 and 42 to form an edge-coupled stripline transmission line. Since this transmission line is balanced, it efficiently transfers EM power from the feed section 20 to the radiating section 22. In the FIG. 1*a* embodiment, the ground plane 12 and the feed section 20 are generally orthogonal to the radiating sections 21, 22.

Figure 1C:
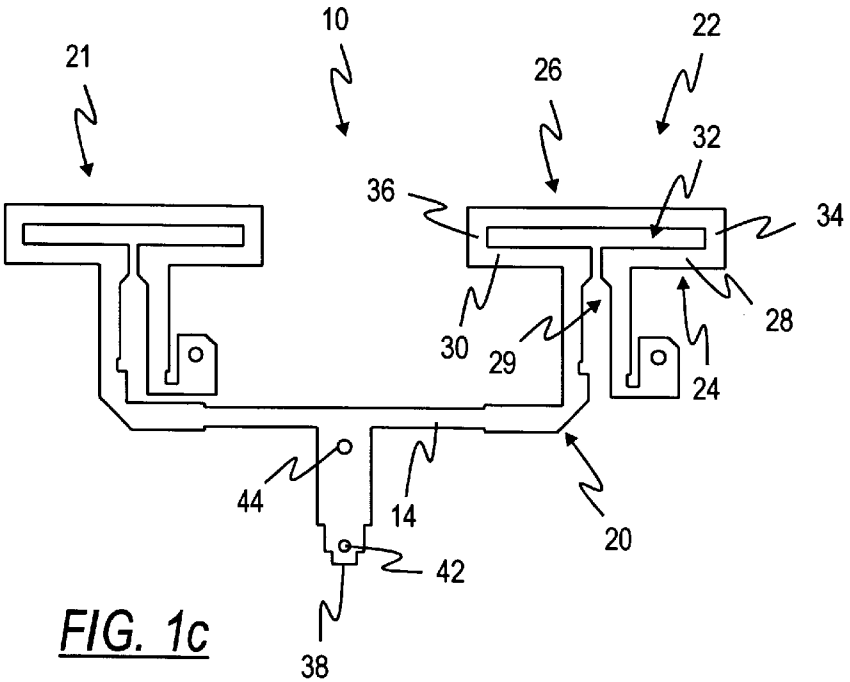
FIG. 1*c* is a top view of a conductor before it is bent into the folded dipole antenna of FIG. 1*a;*

Referring to FIG. 1*c*, there is shown a top view of the conductor 14 before it is bent into the folded dipole antenna 10 of FIG. 1*a*. A hole 42 is provided in the RF input section 38 to aid in connecting the RF input section 38 to a conductor of a transmission line or RF device. One or more holes 44 are provided to facilitate attachment of one or more dielectric supports between the feed section 20 and the ground plane 12. The dielectric supports may include spacers, nuts and bolts with dielectric washers, screws with dielectric washers, etc.

Figure 1D:
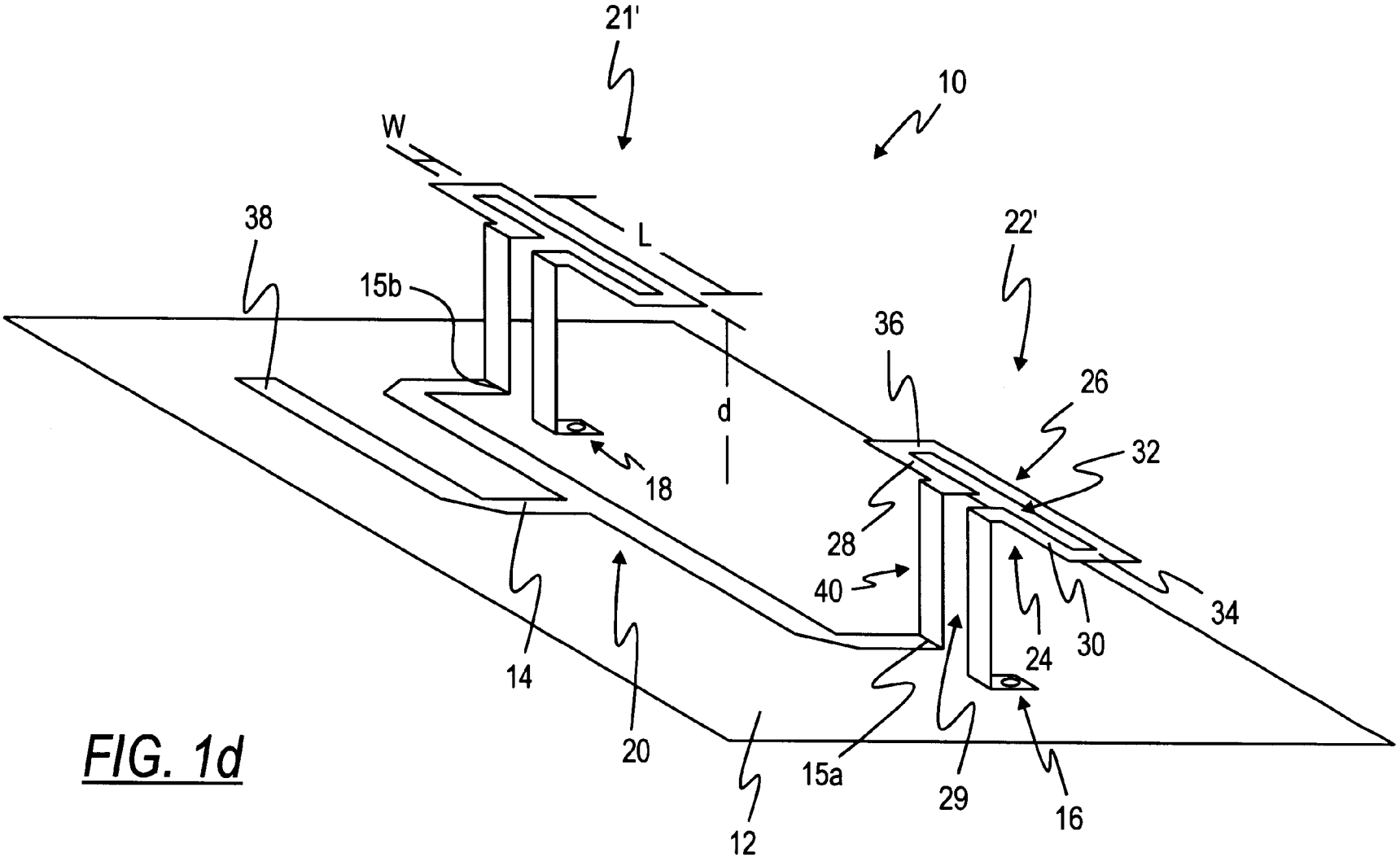
FIG. 1*d* is an isometric view of a folded dipole antenna according to a further embodiment of the present invention.

In another embodiment, the conductor 14 is bent to form radiating sections 21', 22', as shown in FIG. 1*d*. In this embodiment, the conductor 14 is bent such that the passive dipoles 26 of each radiating section 21' and 22' are generally perpendicular to the respective conductor sections 40 and are generally parallel to the ground plane 12.

Figure 1E:
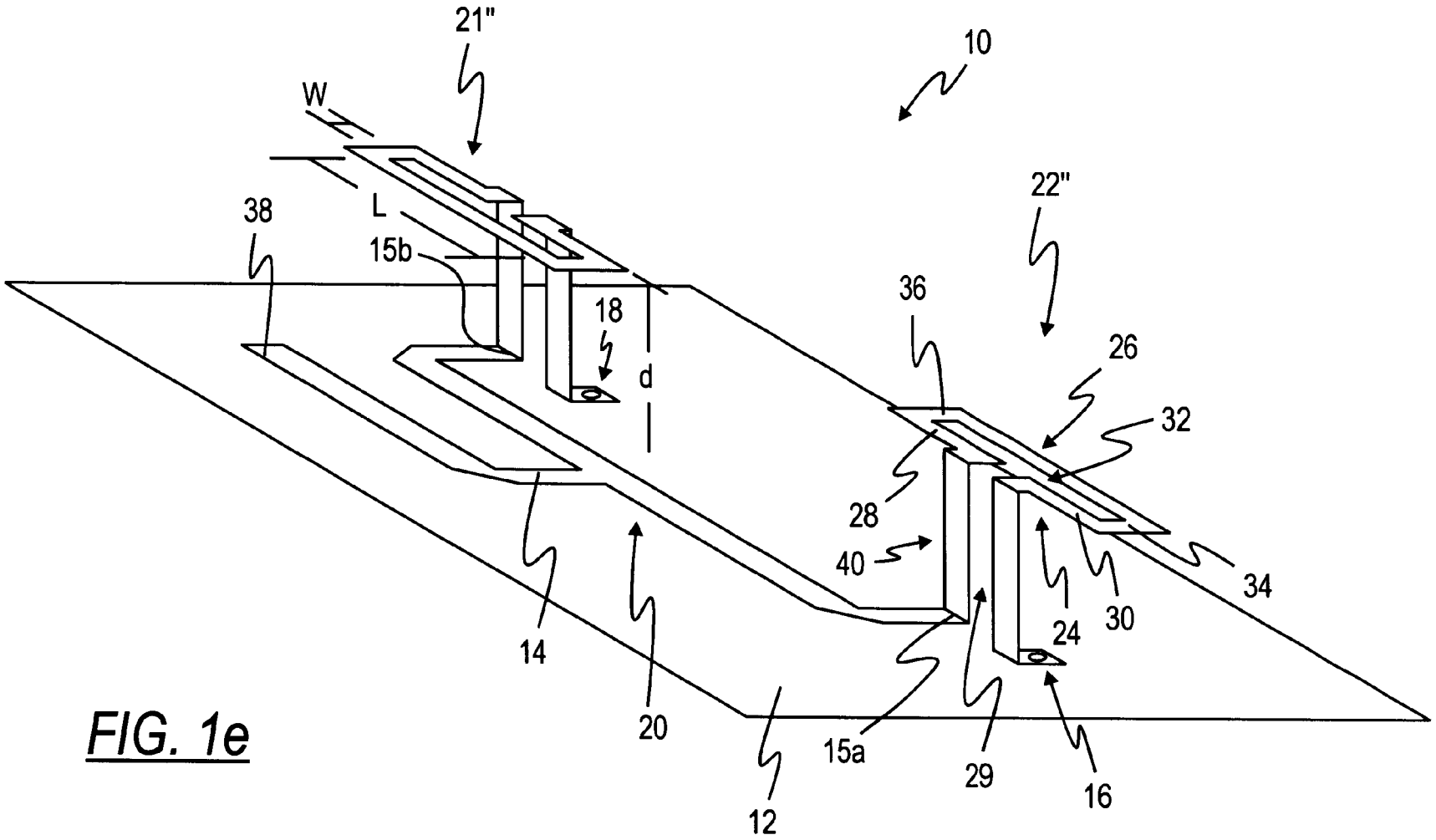
FIG. 1*e* is an isometric view of a folded dipole antenna according to another embodiment of the present invention.

In still another embodiment, radiating sections 21", 22" are bent in opposite directions such that the passive dipoles 26 of each radiating section 21" and 22" are disposed about 180 degrees from each other, are generally perpendicular to the respective conductor sections 40, and are each generally parallel to the ground plane 12, as shown in FIG. 1*e*.

Figure 2:
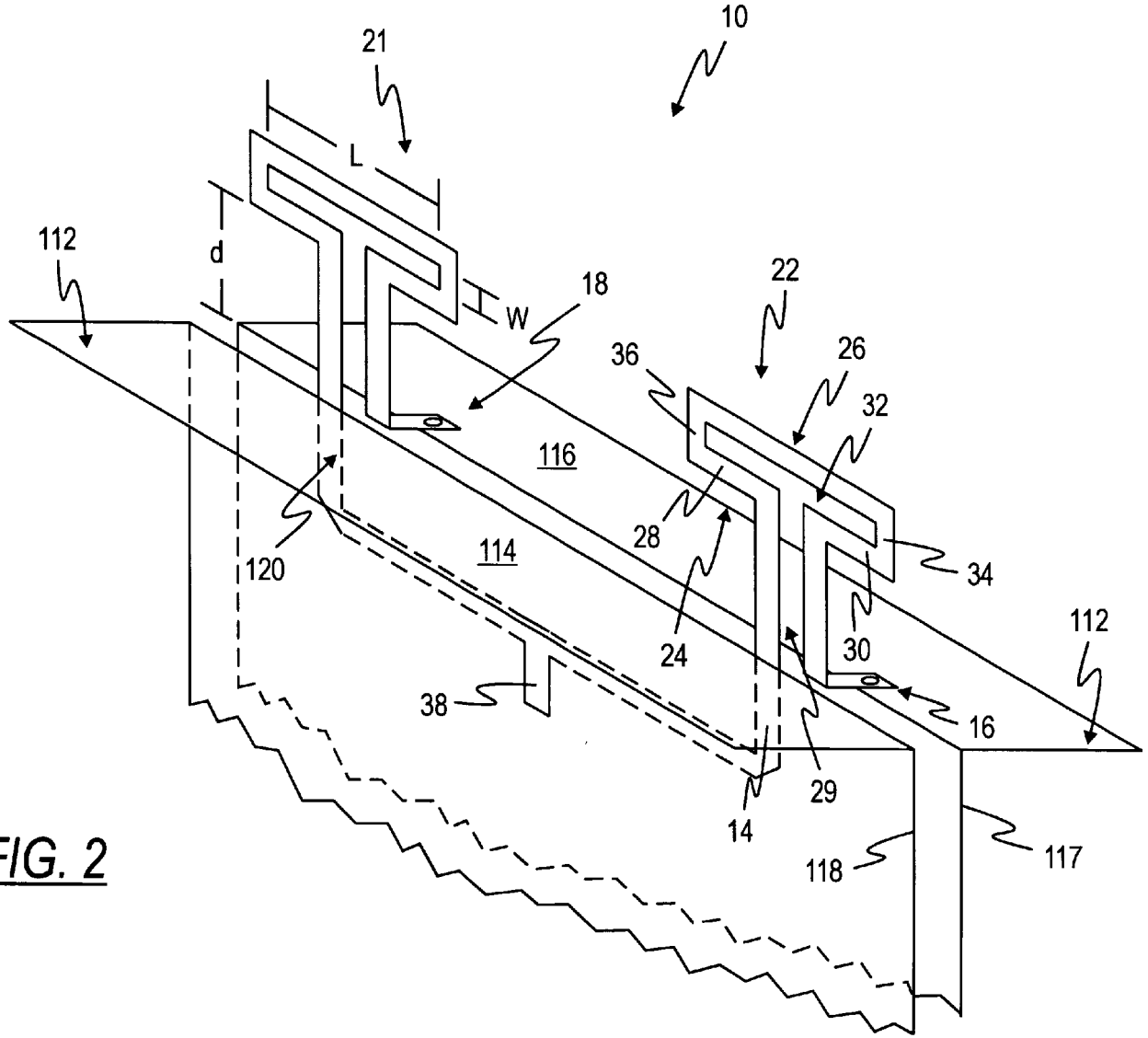
FIG. 2 is an isometric view of a folded dipole antenna according to still another embodiment of the present invention.

Referring to another embodiment in FIG. 2, a ground plane 112 is provided which comprises four sections 114, 116, 117, and 118. Sections 114 and 116 are generally co-planar horizontal sections while sections 117 and 118 are generally opposing vertical walls. In this embodiment, the feed section 120 is disposed between the two generally vertical walls 117, 118. The walls 117, 118 of the ground plane 112 are generally parallel to the feed section 120. The feed section 120 and the walls 117, 118 form a triplate microstrip transmission line. The feed section 120 is spaced from the walls 117, 118 by a dielectric such as air, foam, etc. The two sections 114 and 116 are each generally orthogonal to the radiating sections 21, 22.

Figure 3:
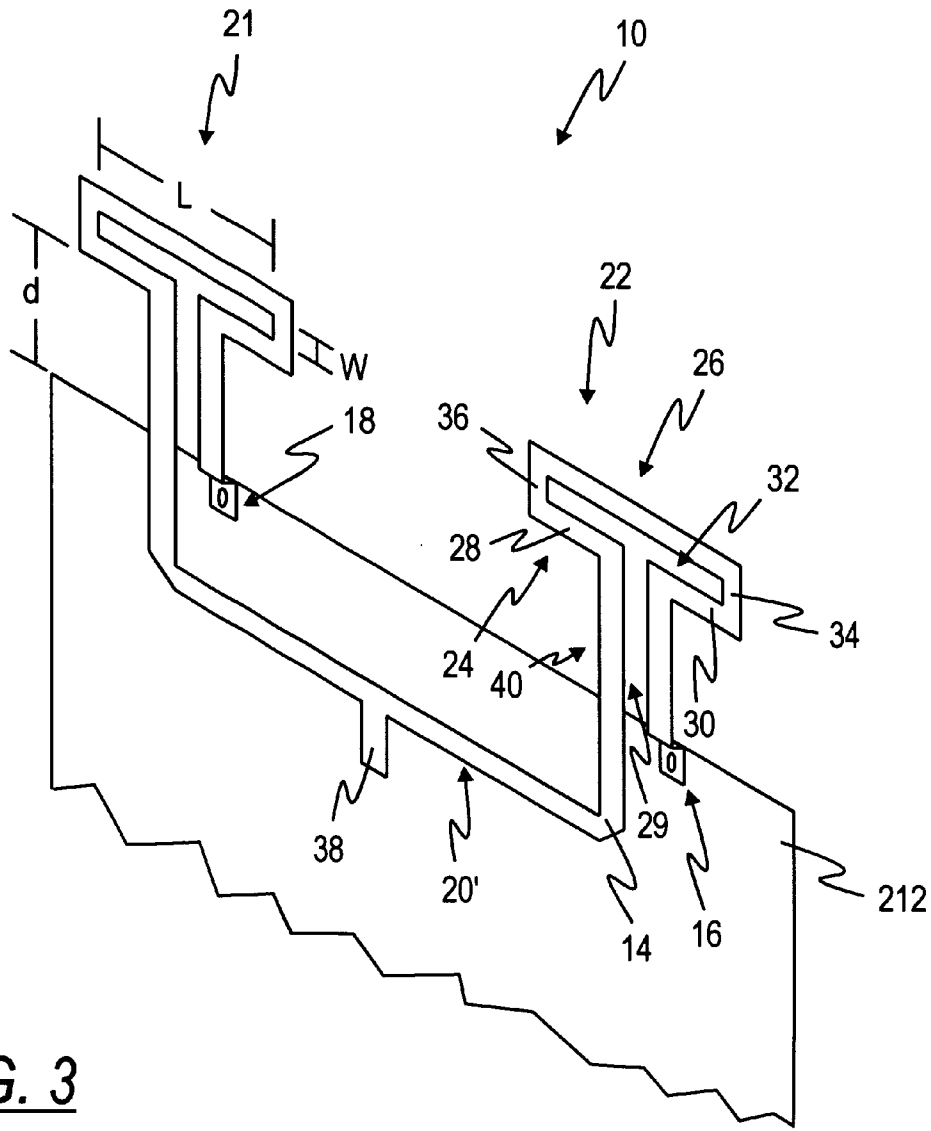
FIG. 3 is an isometric view of a folded dipole antenna according to a further embodiment of the present invention.

In a further embodiment shown in FIG. 3, a ground plane 212 is provided which is generally vertical. The feed section 20 and the radiating sections 21, 22 are thus all generally parallel to the ground plane 212. In this embodiment, the fed dipole 24 should be a distance d from the top edge of the ground plane 212 to insure proper transmission and reception. In one embodiment, the distance d=1.22". If the ground plane 212 extends beyond the point where the radiator input section 40 begins, transmission and reception can be impaired.

In the embodiments of FIGS. 2 and 3, the conductor 14 is generally vertical (i.e., is not bent along most of its length). Although the conductor 14 shown in FIGS. 2 and 3 is bent for attachment to locations 16, 18 on the ground planes 112, 212, respectively; alternatively, the conductor 14 could be unbent along its entire length such that the conductor 14 can be made from a non-bendable dielectric substrate microstrip which is attached directly to the ground planes 112, 212, respectively, by, e.g., bonding.

Figure 4A:
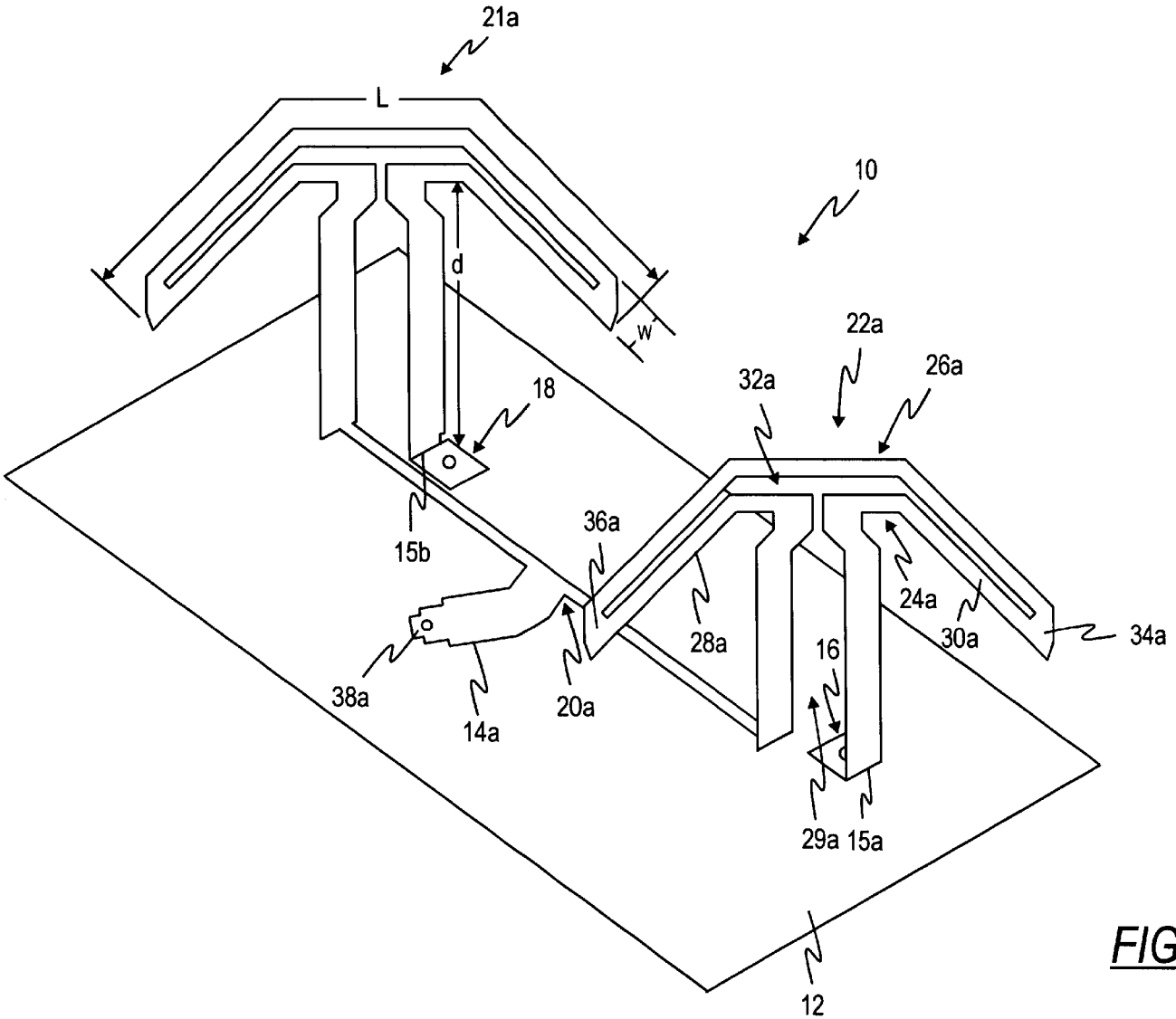
FIG. 4*a* is an isometric view of a folded dipole antenna according to still another embodiment of the present invention.

In another embodiment shown in FIG. 4*a*, radiating sections 21*a*, 22*a* are supported on the ground plane 12 and are generally orthogonal thereto. A conductor 14*a* is bent at bends 15*a* and 15*b* such that the feed section 20*a* is supported by and displaced from the ground plane 12. The ends 34*a*, 36*a* of the radiating sections 21*a*, 22*a* are bent downward towards the ground plane 12. This configuration minimizes the size of the resulting antenna 10. In addition, bending the radiating sections 21*a*, 22*a* increases the E-plane Half Power Beamwidth (HPBW) of the far-field pattern of the resulting antenna. This embodiment is particularly attractive for producing far-field patterns that have nearly identical E-plane and H-plane co-polarization patterns in the far-field. In addition, one or more such radiating sections may be used for slant-45 degree radiation, in which the radiating sections are arranged in a vertically disposed row, with each radiating section rotated so as to have its co-polarization at a 45 degree angle with respect to the center axis of the vertical row. In the downwardly bent radiation section embodiment, when patterns are cut in the horizontal plane for the vertical and horizontal polarizations, the patterns will be very similar over a broad range of observation angles.

Figure 4B:
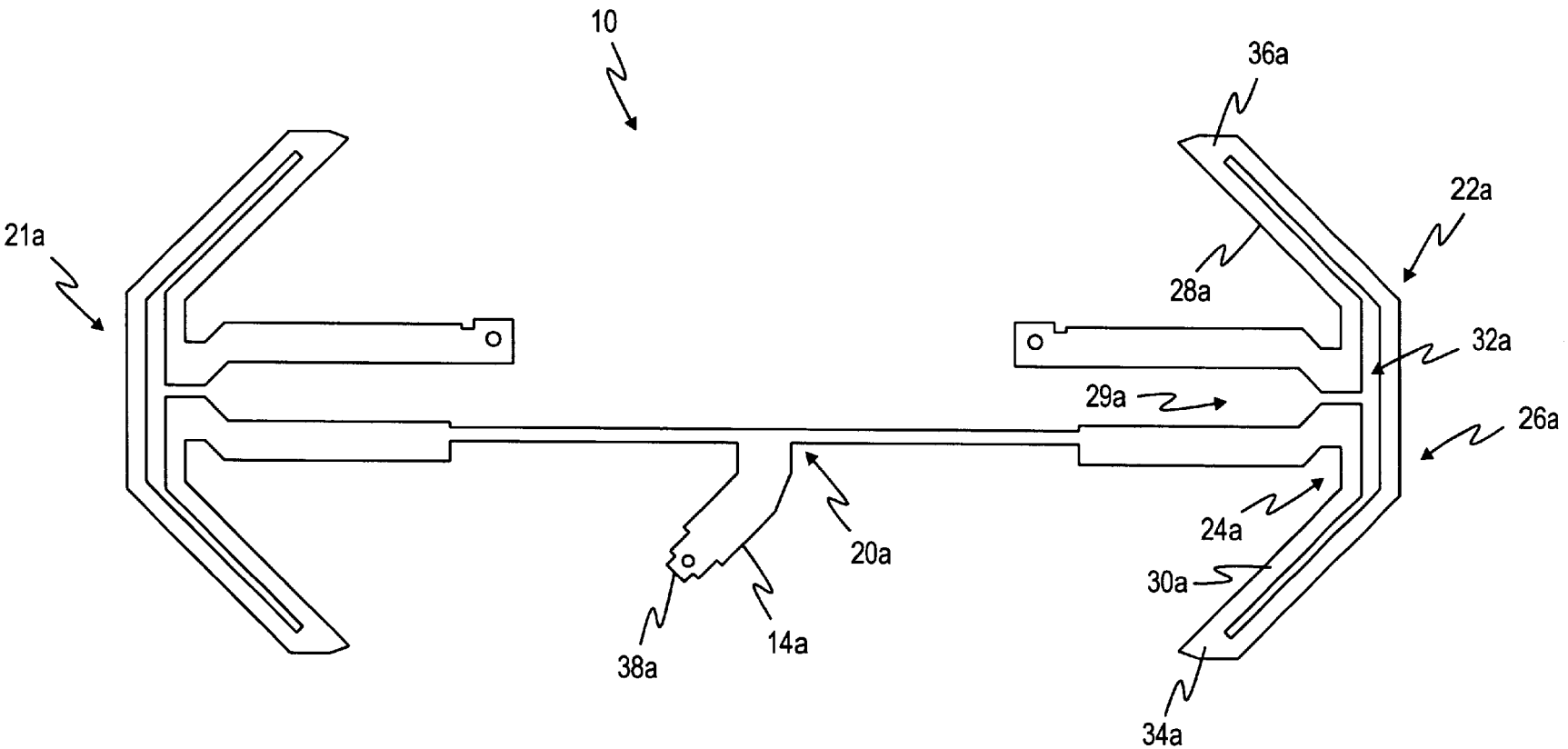
FIG. 4*b* is a top view of a conductor before it is bent into the folded dipole antenna of FIG. 4*a*.

FIG. 4*b* illustrates a top view of the conductor 14*a* before it is bent into the folded dipole antenna 10 of FIG. 4*a*. In the embodiment of FIGS. 4*a* and 4*b*, a passive dipole 26*a* is disposed in spaced relation to a fed dipole 24*a* to form a gap 32*a*. The passive dipole 26*a* is shorted to the fed dipole 24*a* at the ends 34*a* and 36*a*. The gap 32*a* forms a first half-wavelength dipole (passive dipole 26*a*) on one side of the gap 32*a* and a second half-wavelength dipole (fed dipole 24*a*) on the other side of the gap 32*a*. Fed dipole 24*a* includes a centrally-located gap 29*a* which forms the first quarter-wavelength monopole 28*a* and the second quarter-wavelength monopole 30*a*. In one embodiment where the antenna 10 is used in the cellular band of 824–896 MHz and the GSM band of 870–960 MHz, the dipole length L is about 6.52", and the dipole width W is about 0.48". In this embodiment, the innermost section of the fed dipole 24*a* is a distance d from the top of the ground plane 12, where the distance d is about 2.89".

Although the illustrated embodiments show the conductor 14 forming two radiating sections 21 and 22, the antenna 10 would operate with as few as one radiating section or with multiple radiating sections.

The folded dipole antenna 10 of the present invention provides one or more radiating sections that are integrally formed from the conductor 14. Each radiating section is an integrated part of the conductor 14. Thus, there is no need for separate radiating elements (i.e., radiating elements that are not an integral part of the conductor 14) or fasteners to connect the separate radiating elements to the conductor 14 and/or the ground plane 12. The entire conductor 14 of the antenna 10 can be manufactured from a single piece of conductive material such as, for example, a metal sheet comprised of aluminum, copper, brass or alloys thereof. This improves the reliability of the antenna 10, reduces the cost of manufacturing the antenna 10 and increases the rate at which the antenna 10 can be manufactured. The one piece construction of the bendable conductor embodiment is superior to prior antennas using dielectric substrate microstrips because such microstrips can not be bent to create the radiating elements shown, for example, in FIGS. 1*a–e* and 4*a–b*.

Radiating sections 21, 22 are each fed by conductor sections 41 and 42 which form a balanced edge-coupled stripline transmission line. Since this transmission line is balanced, it is unnecessary to provide a balun. The result is an antenna 10 with very wide impedance bandwidth (e.g., 24%). The impedance bandwidth is calculated by subtracting the highest frequency from the lowest frequency that the antenna can accommodate and dividing by the center frequency of the antenna. In one embodiment, the antenna 10 operates in the PCS, PCN and UMTS frequency bands. Thus, the impedance bandwidth of this embodiment of the antenna 10 is:

$$(2170\ \text{MHz}-1710\ \text{MHz})/1940\ \text{MHz}=24\%$$

Besides having wide impedance bandwidth, the antenna 10 displays a stable far-field pattern across the impedance bandwidth. In the wireless frequency band (1710–2170 MHz) embodiment embodiment, the antenna 10 is a 90 degree azimuthal, half power beam width (HPBW) antenna, i.e., the antenna achieves a 3 dB beamwidth of 90 degrees. To produce an antenna with this HPBW requires a ground plane with sidewalls. The height of the sidewalls is 0.5" and the width between the sidewalls is 6.1". The ground plane in this embodiment is aluminum having a thickness of 0.06". In another wireless frequency band (1710–2170 MHz) embodiment, the antenna 10 is a 65 degree azimuthal HPBW antenna, i.e., the antenna achieves a 3 dB beamwidth of 65 degrees. To produce an antenna with this HPBW also requires a ground plane with sidewalls. The height of the sidewalls is 1.4" and the width between the sidewalls is 6.1". The ground plane in this embodiment is also aluminum having a thickness of 0.06".

The antenna 10 can be integrated into existing single-polarization antennas in order to reduce costs and increase the impedance bandwidth of these existing antennas to cover the cellular, GSM, PCS, PCN, and UMTS frequency bands.

While the present invention has been described with reference to one or more preferred embodiments, those skilled in the art will recognize that many changes may be made thereto without departing from the spirit and scope of the present invention which is set forth in the following claims.

What is claimed is:

1. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the radiator input section includes a first conductor section and a second conductor section separated by a second gap wherein the first conductor section is electrically connected to the ground plane by a fastener.

2. The folded dipole antenna of claim 1, wherein the first conductor section is electrically connected to the ground plane by a process selected from the group consisting of soldering, welding, brazing, and cold forming.

3. The folded dipole antenna of claim 1, wherein the second conductor section is integral with the feed section.

4. The folded dipole antenna of claim 1, wherein the first and second ends of the radiating section are bent downward towards the ground plane.

5. The folded dipole antenna of claim 1, wherein the passive dipole is disposed parallel to the fed dipole.

6. The folded dipole antenna of claim 1, wherein the ground plane is generally orthogonal to the radiating section.

7. The folded dipole antenna of claim 1, wherein the ground plane is generally parallel to the radiating section.

8. The folded dipole antenna of claim 1, wherein the ground plane comprises two sections that are each generally orthogonal to the radiating section.

9. The folded dipole antenna of claim 1, wherein the ground plane includes two spaced sections, the feed section extending between the two sections.

10. The folded dipole antenna of claim 1, wherein the ground plane includes four sections, two sections being generally horizontal and two sections being generally vertical, the feed section extending between the two generally vertical sections.

11. The folded dipole antenna of claim 1, wherein the ground plane is generally horizontal and the radiating section is generally parallel to the ground plane.

12. The folded dipole antenna of claim 1, wherein the gap has a length and a width, the length being greater than the width.

13. The folded dipole antenna of claim 1, wherein the conductor forms two radiating sections.

14. The folded dipole antenna of claim 1, wherein the conductor includes an RF input section that is adapted to electrically connect to an RF device.

15. The folded dipole antenna of claim 1, wherein the conductor is integrally formed from a sheet of metal.

16. A folded dipole antenna for transmitting and receiving electromagnetic signals comprising:

a ground plane; and a conductor extending adjacent the ground plane and spaced therefrom by a dielectric, the conductor being connected to the ground plane at one or more locations, the conductor including three sections, a feed section, a radiator input section, and at least one radiating section integrally formed with the radiator input section and the feed section, the feed section including an RF input section that is adapted to electrically connect to an RF device, the radiating section including a fed dipole and a passive dipole, the fed dipole being connected to the radiator input section, the passive dipole being disposed parallel to and spaced from the fed dipole to form a gap, the passive dipole being shorted to the fed dipole at opposing ends of the gap;

wherein the first conductor section is electrically connected to the ground plane by a fastener and further including connecting the first conductor section to the ground plane by a fastener.

17. The folded dipole antenna of claim 16, wherein the ground plane is generally orthogonal to the radiating section.

18. The folded dipole antenna of claim 16, wherein the ground plane is generally parallel to the radiating section.

19. The folded dipole antenna of claim 16, wherein the ground plane comprises two sections that are each generally orthogonal to the radiating section.

20. The folded dipole antenna of claim 16, wherein the ground plane includes two spaced sections, the feed section extending between the two sections.

21. The folded dipole antenna of claim 16, wherein the ground plane includes four sections, two sections being generally horizontal and two sections being generally vertical, the feed section extending between the two generally vertical sections.

22. The folded dipole antenna of claim 16, wherein the ground plane is generally horizontal and the radiating section is generally parallel to the ground plane.

23. The folded dipole antenna of claim 16, wherein the radiator input section includes a first conductor section and a second conductor section separated by a second gap.

24. The folded dipole antenna of claim 23, wherein the first conductor section is electrically connected to the ground plane by a process selected from the group consisting of soldering, welding, brazing, and cold forming.

25. The folded dipole antenna of claim 23, wherein the second conductor section is integral with the feed section.

26. The folded dipole antenna of claim 16, wherein the gap has a length and a width, the length being greater than the width.

27. The folded dipole antenna of claim 16, wherein the conductor forms two radiating sections.

28. The folded dipole antenna of claim 16, wherein the transmission line is electrically connected to an RF device.

29. The folded dipole antenna of claim 16, wherein the conductor is integrally formed from a sheet of metal.

30. A method of making a folded dipole antenna for transmitting and receiving electromagnetic signals comprising:

providing a ground plant and a conductor including three sections, a feed section, a radiator input section, and at least one radiating section integrally formed with the radiator input section and the feed section, the radiating section including first and second ends, a fed dipole and a passive dipole;

extending the conductor adjacent to the ground plane and spacing the conductor from the ground plane by a dielectric;

connecting the fed dipole to the radiator input section;

spacing the passive dipole from the fed dipole to form a gap; and shorting the passive dipole to the fed dipole at the first and second ends;

wherein the radiator input section includes a first conductor section and a second conductor section separated by a second gap.

31. The method of claim 30, wherein the radiator input section includes a first conductor section and a second conductor section separated by a second gap and further including connecting the first conductor section to the ground plane by a fastener.

32. The method of claim 31, further including integrally forming the second conductor section with the feed section.

33. The method of claim 30, further including bending the first and second ends of the radiating section downward towards the ground plane.

34. The method of claim 30, further including integrally forming the conductor from a sheet of metal.

35. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the radiator input section includes a first conductor section and a second conductor section separated by a second gap; and wherein the first conductor section is electrically connected to the ground plane by a process selected from the group consisting of soldering, welding, brazing, and cold forming.

36. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the first and second ends of the radiating section are bent downward towards the ground plane.

37. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the ground plane is generally orthogonal to the radiating section.

38. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the ground plane comprises two sections that are each generally orthogonal to the radiating section.

39. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the ground plane includes four sections, two sections being generally horizontal and two sections being generally vertical, the feed section extending between the two generally vertical sections.

40. A folded dipole antenna for transmitting and receiving electromagnetic signals comprising:

a ground plane; and a conductor extending adjacent the ground plane and spaced therefrom by a dielectric, the conductor including three sections, a feed section, a radiator input section, and at least one radiating section integrally formed with the radiator input section and the feed section, the radiating section including first and second ends, a fed dipole and a passive dipole, the fed dipole being connected to the radiator input section, the passive dipole being disposed in spaced relation to the fed dipole to form a gap, the passive dipole being shorted to the fed dipole at the first and second ends;

wherein the ground plane is generally horizontal and the radiating section is generally parallel to the ground plane.

41. A folded dipole antenna for transmitting and receiving electromagnetic signals comprising:

a ground plane; and a conductor extending adjacent the ground plane and spaced therefrom by a dielectric, the conductor being connected to the ground plane at one or more locations, the conductor including three sections, a feed section, a radiator input section, and at least one radiating section integrally formed with the radiator input section and the feed section, the feed section including an RF input section that is adapted to electrically connect to an RF device, the radiating section including a fed dipole and a passive dipole, the fed dipole being connected to the radiator input section, the passive dipole being disposed parallel to and spaced from the fed dipole to form a gap, the passive dipole being shorted to the fed dipole at opposing ends of the gap;

wherein the ground plane is generally orthogonal to the radiating section.

42. A folded dipole antenna for transmitting and receiving electromagnetic signals comprising:

a ground plane; and a conductor extending adjacent the ground plane and spaced therefrom by a dielectric, the conductor being connected to the ground plane at one or more locations, the conductor including three sections, a feed section, a radiator input section, and at least one radiating section integrally formed with the radiator input section and the feed section, the feed section including an RF input section that is adapted to electrically connect to an RF device, the radiating section including a fed dipole and a passive dipole, the fed dipole being connected to the radiator input section, the passive dipole being disposed parallel to and spaced from the fed dipole to form a gap, the passive dipole being shorted to the fed dipole at opposing ends of the gap;

wherein the ground plane comprises two sections that are each generally orthogonal to the radiating section.

43. A folded dipole antenna for transmitting and receiving electromagnetic signals comprising:

a ground plane; and a conductor extending adjacent the ground plane and spaced therefrom by a dielectric, the conductor being connected to the ground plane at one or more locations, the conductor including three sections, a feed section, a radiator input section, and at least one radiating section integrally formed with the radiator input section and the feed section, the feed section including an RF input section that is adapted to electrically connect to an RF device, the radiating section including a fed dipole and a passive dipole, the fed dipole being connected to the radiator input section, the passive dipole being disposed parallel to and spaced from the fed dipole to form a gap, the passive dipole being shorted to the fed dipole at opposing ends of the gap;

wherein the ground plane includes four sections, two sections being generally horizontal and two sections being generally vertical, the feed section extending between the two generally vertical sections.

44. A folded dipole antenna for transmitting and receiving electromagnetic signals comprising:

a ground plane; and a conductor extending adjacent the ground plane and spaced therefrom by a dielectric, the conductor being connected to the ground plane at one or more locations, the conductor including three sections, a feed section, a radiator input section, and at least one radiating section integrally formed with the radiator input section and the feed section, the feed section including an RF input section that is adapted to electrically connect to an RF device, the radiating section including a fed dipole and a passive dipole, the fed dipole being connected to the radiator input section, the passive dipole being disposed parallel to and spaced from the fed dipole to form a gap, the passive dipole being shorted to the fed dipole at opposing ends of the gap;

wherein the radiator input section includes a first conductor section and a second conductor section separated by a second gap;

wherein the first conductor section is electrically connected to the ground plane by a process selected from the group consisting of soldering, welding, brazing, and cold forming.

45. A folded dipole antenna for transmitting and receiving electromagnetic signals comprising:

a ground plane; and a conductor extending adjacent the ground plane and spaced therefrom by a dielectric, the conductor being connected to the ground plane at one or more locations, the conductor including three sections, a feed section, a radiator input section, and at least one radiating section integrally formed with the radiator input section and the feed section, the feed section including an RF input section that is adapted to electrically connect to an RF device, the radiating section including a fed dipole and a passive dipole, the fed dipole being connected to the radiator input section, the passive dipole being disposed parallel to and spaced from the fed dipole to form a gap, the passive dipole being shorted to the fed dipole at opposing ends of the gap;

wherein the first conductor section is electrically connected to the ground plane by a fastener;

further including connecting the first conductor section to the ground plane by a process selected from the group consisting of soldering, welding, brazing, and cold forming.

46. A method of making a folded dipole antenna for transmitting and receiving electromagnetic signals comprising:

providing a ground plane and a conductor including three sections, a feed section, a radiator input section, and at least one radiating section integrally formed with the radiator input section and the feed section, the radiating section including first and second ends, a fed dipole and a passive dipole;

extending the conductor adjacent to the ground plane and spacing the conductor from the ground plane by a dielectric;

connecting the fed dipole to the radiator input section;

spacing the passive dipole from the fed dipole to form a gap; and shorting the passive dipole to the fed dipole at the first and second ends;

further including bending the first and second ends of the radiating section downward towards the ground plane.

* * * * *

UNITED STATES PATENT AND TRADEMARK OFFICE

CERTIFICATE OF CORRECTION

PATENT NO. : 6,285,336 B1
DATED : September 4, 2001
INVENTOR(S) : Zimmerman

It is certified that error appears in the above-identified patent and that said Letters Patent is hereby corrected as shown below:

Column 8, claim 30,
Line 21, delete "plant" and replace it with -- plane --.

Signed and Sealed this

Twelfth Day of March, 2002

*Attest:*

*Attesting Officer*

JAMES E. ROGAN
*Director of the United States Patent and Trademark Office*